US005370718A

United States Patent [19]

Terazawa et al.

[11] Patent Number: 5,370,718

[45] Date of Patent: Dec. 6, 1994

[54] ABRASIVE TAPE

[75] Inventors: Masatoshi Terazawa; Toshisada Inoue, both of Kyoto, Japan

[73] Assignee: Hitachi Maxell, Ltd., Osaka, Japan

[21] Appl. No.: 46,931

[22] Filed: Apr. 14, 1993

Related U.S. Application Data

[63] Continuation of Ser. No. 746,350, Aug. 16, 1991, abandoned.

[30] Foreign Application Priority Data

Aug. 22, 1990 [JP] Japan ..... 2-222231

[51] Int. Cl.[5] ..... B24D 11/00

[52] U.S. Cl. ..... 51/295; 51/296; 451/534

[58] Field of Search ..... 51/293, 295, 296, 402; 428/148, 149, 307.3, 317.1, 317.5; 427/243, 244

[56] References Cited

U.S. PATENT DOCUMENTS

| | | | |
|---|---|---|---|
| 2,876,086 | 6/1954 | Raymond | 51/293 |
| 3,607,159 | 9/1971 | Haywood | 51/296 |
| 3,773,480 | 11/1973 | Hall | 51/296 |
| 3,906,684 | 9/1975 | Marshall | 51/296 |
| 3,915,671 | 10/1975 | Kagawa | 51/296 |
| 4,038,047 | 7/1977 | Haywood | 51/296 |
| 4,299,865 | 11/1981 | Clingman et al. | 427/243 |
| 4,938,784 | 7/1990 | Murakami | 51/296 |
| 5,096,464 | 3/1992 | Yamamoto | 51/296 |

FOREIGN PATENT DOCUMENTS 53-44714 11/1978 Japan .

*Primary Examiner*—Mark L. Bell
*Assistant Examiner*—Deborah Jones
*Attorney, Agent, or Firm*—Birch, Stewart, Kolasch & Birch

[57] ABSTRACT

A method of producing an abrasive tape by preparing an abrasive paint containing abrasive grains having a grain size of 0.05 to 10 μm and containing air bubbles which, upon coating of a flexible substrate, form an abrasive layer having pores in content of 10 to 60% by volume based on a volume of said abrasive layer.

6 Claims, No Drawings

ABRASIVE TAPE

This application is a continuation, of application Ser. No. 07/746,350 filed on Aug. 16, 1991, now abandoned.

BACKGROUND OF THE INVENTION

1. Field of the Invention

The present invention relates to an abrasive tape, and more particularly, it relates to an abrasive tape having an excellent and uniform polishing property over its entire length without causing scratching flaws on the surface of a polished material.

Since the abrasive tape is easy to handle, it is frequently used for polishing the surface of a material such as a flexible magnetic disk, a magnetic tape, a magnetic head, a plastic product, a mold, an optical fiber and various machine parts.

In general, these polished materials should be precision processed, and therefore scratches on their surface usually make trouble.

2. Description of the Related Art

In general, the abrasive tape comprises a flexible substrate such as a polyester film, and an abrasive layer which is formed on the flexible substrate and contains a binder resin and an abrasive grain, such as $Al_2O_3$, $Cr_2O_3$, $SiO_2$ and SiC powders, and is widely used to smoothen the surface of the polished material, for example, the flexible disk and the magnetic disk by polishing minute protrusions on the surface of the polished material. (cf. Japanese Patent Koukoku Publication No. 44714/1978.)

However, since such conventional abrasive tape has a hard and tough abrasive layer, some minute protrusions of the polished surface drop in the form of pieces without being abraded and adhere to the surface of the abrasive tape, and then scratch the surface of the polished material, such as a magnetic layer. The scratches on the polished surface tend to damage the polished material completely.

SUMMARY OF THE INVENTION

An object of the present invention is to provide an abrasive tape which has excellent polishing properties in its entire length and prevents scratching of the polished surface.

According to the present invention, there is provided an abrasive tape comprising a flexible substrate, and an abrasive layer which is formed on the substrate and comprises an abrasive grain and a binder resin, wherein the abrasive layer contains pores in a content of from 10 to 60% by volume based on the volume of the abrasive layer and more preferably 20 to 50% by volume.

DETAILED DESCRIPTION OF THE INVENTION

At first, to prevent scratching of the polished surface, it was thought that it would be sufficient to suppress projection of debris which adheres to the tape by holding the debrise in holes respectively formed in the soft abrasive layer containing a soft binder resin.

However, after conducting experiments according to the above thought, it was found that the problem could not be solved by the above measure in which the abrasive tape was formed only by using a soft binder resin, since there is a large difference in the polishing property between initial parts and end parts of the abrasive tape after being stored in a wound state. Thus, it is difficult to satisfy the required property of an abrasive tape that it should have the excellent and uniform polishing properties over its entire length in an industrial polishing process.

To solve the above problem, the present invention provides a novel structure of an abrasive layer which can hold debris which causes scratching, not by using a soft binder resin in the abrasive layer, but by causing depressions in the abrasive layer in response to the shape of the debris to hold the debris in the abrasive layer more tightly.

In order to provide such a structure, the abrasive layer should deform in response to the shape of the debris only when debris adheres to the surface of the abrasive layer, and should not deform by the winding pressure of the tape alone.

As a result of extensive study, it has been found that not a special additive, but pores in the abrasive layer are very effective to accomplish the above purpose.

That is, by providing pores in the abrasive layer, it is not necessary to use a soft binder resin in the abrasive layer. Therefore, the abrasive tape according to the present invention has an excellent and uniform polishing property over its entire length, even when the abrasive tape is stored in a wound state.

For example, when a surface of the magnetic layer of a flexible magnetic disk or a magnetic tape is polished, the abrasive tape will not scratch the polished surface of the magnetic layer by the debris which is held in the abrasive layer, because depressions are formed in the abrasive layer through crushing of the pores by pressure of the hard debris and the debris is held without projecting from the abrasive layer.

According to the present invention, the abrasive tape can polish the surface to be polished smoothly without scratching. For example, in the case of polishing a surface of a magnetic recording medium, the magnetic recording medium can record and reproduce signals without drop out caused by scratches on the surface of the medium.

In the present invention, a total volume of the pores in the abrasive layer is preferably from 10% to 60% by volume based on the volume of the abrasive layer, such that the abrasive layer having a total pore volume in this range exhibits a sponge-like structure and plasticity, and is able to contact with the polished surface softly.

The total pore volume in the abrasive layer, which is calculated on the assumption that all of the pores in the abrasive layer are crushed by the pressure of calendering which is carried out under a linear pressure of 200 $kg/cm^2$ at temperature of 80° C. at a rate of 200 m/s, is preferably from 10% to 60% by volume based on the volume of the abrasive layer and more preferably 20 to 50% by volume. To this end, the pores are preferably open pores since they should readily hold the debris.

The size of each pore is preferably smaller than an average size of the abrasive grain in the abrasive layer.

The abrasive tape comprising the abrasive layer which has been explained above can gradually polish only the minute protrusions on the surface of the material to be polished, such as the flexible disk and the magnetic tape, without dropping pieces of the minute protrusions from the surface. Therefore, it can polish the surface of the magnetic layer of such as the flexible disk and the magnetic tape smoothly without the adhesion of the pieces of the minute protrusions to the abrasive layer and without scratching the surface with the pieces, thereby preventing drop-out of magnetic recording signals caused by scratches on the surface, during recording and playing.

In general, the abrasive tape is produced by applying an abrasive paint comprising abrasive grains, a binder resin and an organic solvent on a substrate film and drying the abrasive paint to form the abrasive layer. Some general methods for producing the abrasive paint will be explained.

The abrasive layer having the pores is prepared by using an abrasive paint comprising abrasive grains, binder resin and an organic solvent.

In a first embodiment, the abrasive paint containing the binder resin in a relatively small amount is prepared and the abrasive grains dispersed therein.

In a second embodiment, the abrasive paint contains air bubbles formed by mechanical stirring.

In a third embodiment, the abrasive paint contains bubbles formed by a reaction of at least 2 kinds of binder resins which react with each other and generate bubbles.

In the case of using the abrasive paint containing the binder resin in a relatively small amount, to form the desired content of the pores, the content of the binder resin is adjusted to at most 95% by volume based on the volume of the abrasive grains.

When the abrasive paint contains the binder resin in an insufficient amount to cover all the surfaces of the abrasive grains, the content of the abrasive grain is preferably at least 40% by volume, namely the content of the binder resin is preferably at most 60% by volume.

In the present invention, any conventionally binder resin may be used independently or in combination. Examples of binder resins are vinyl chloride-vinyl acetate copolymer, polyvinyl butyral resin, cellulose resin, polyester resin, polyurethane resin, epoxy resin, polyether resin, isocyanate compound, radiation curing resin, etc. When the pores in the abrasive layer are generated by the reaction of the resins, the isocyanate compound, the polyester and water which react with each other are used as the binder resins, and in this case, molecular weights of resins are not critical.

Thus it can be avoided to select a soft binder resin which has different polishing properties between the initial parts and the end parts of the abrasive tape which is stored in the wound state.

As the abrasive grains for the abrasive layer, powders which have adequate hardness and can polish the surface of the magnetic layer such as powder of $Al_2O_3$, $Cr_2O_3$, $SiO_2$, SiC are used independently or in combination. For achieving high polishing efficiency, the content of the abrasive grains in the abrasive layer is preferably from 20% to 95% by weight, more preferably from 50% to 90% by weight based on the total weight of all the solid elements.

Though the suitable grain size of the abrasive grains depends on the use and/or the kind of the material to be polished, when the surface to be polished is a magnetic tape or a magnetic disk, the grain size of the abrasive grains is preferably from 0.05 μm to 10 μm.

In the present invention, any conventionally used organic solvents may be used independently or in combination. Example of organic solvents are acetone, methyl isobutyl ketone, methyl ethyl ketone, cyclohexanone, toluene, ethyl acetate, tetrahydrofuran, and dimethylformamide. In addition, any conventional additive, such as a lubricant, a dispersant and a filler may be added to the abrasive layer.

PREFERRED EXAMPLES OF THE INVENTION

The present invention will be explained further in detail by the following Examples, in which "parts" are by weights unless otherwise indicated.

Examples 1-2 and Comparative Examples 1-2

The following components were well kneaded and dispersed in a ball mill for 48 hours to prepare an abrasive paint:

| Component | parts |
|---|---|
| α-$Al_2O_3$ powder (grain size 1 μm) | 80 |
| Polyurethane resin A or B | X |
| Methyl ethyl ketone | 20 |
| Toluene | 80 |

Then, the abrasive paint was coated on one surface of a polyester film having a thickness of 50 μm and dried to forman abrasive layer having a thickness of 10 μm. Next, the coated film was cut to produce 4 types of abrasive tapes having a desired width. The kind and amount of polyurethane resin are shown in Table 1.

TABLE 1

| | Polyurethane | Amount of polyurethane (wt %) | Content of pores (vol %) |
|---|---|---|---|
| Example 1 | A | 20 | 30 |
| Example 2 | B | 15 | 40 |
| Comparative Example 1 | A | 30 | 5 |
| Comparative Example 2 | B | 30 | 5 |

Polyurethane resin A is Pandex T-5201 (manufactured by Dainippon Ink Kagaku kogyou, Tg=−130° C.) which is known as a relatively soft resin, and Polyurethane resin B is N-2301 (manufactured by Nippon Polyuretane, Tg=22° C.) which is known as a relatively hard resin.

The content of the pores in the abrasive layer of each of the tapes produced in Examples and Comparative Example was calculated on the assumption that all of the pores in the abrasive layer were crushed by the pressure of calendaring which is carried out under a linear pressure of 200 kg/cm$^2$ at temperature of 80° C. at a rate of 200 m/s.

After polishing a surface of a flexible disk by using the end parts of the abrasive tape which were once wound around a hub, formation of scratches, adhesion of debris and roughness of a polished surface were observed. The conditions of the polished surface were observed in the same manner after polishing the surface of the flexible disk by using the initial parts of the abrasive tape.

TABLE 2

| | Content of pores (%) | Scratches on polished surface | Debris on tape surface | Roughness of polished surface (μm) | |
|---|---|---|---|---|---|
| | | | | Initial | End |
| Example 1 | 30 | No | No | 0.111 | 0.111 |
| Example 2 | 40 | No | No | 0.111 | 0.111 |
| Comparative Example 1 | 5 | Yes | Yes | 0.112 | 0.125 |
| Comparative Example 2 | 5 | Yes | Yes | 0.112 | 0.112 |

As seen from the results of Table 2, the abrasive tapes having many pores in the abrasive layer according to the present invention (Examples 1 and 2) exhibited the excellent polishing property the entire length of the abrasive tape from the initial part to the end part of the tape which was once wound around the hub, and could polish the surface of the disk without scratching or adhesion of debris on the surface.

On the other hand, once the abrasive tape using the soft binder resin in the abrasive layer instead of providing the pores to form the soft abrasive layer (Comparative Example 1) was wound around a hub, the tape developed irregularities in the abrasive layer because of winding pressure so that the polishing property of the parts of the tape near the hub deteriorated. The abrasive tape using the hard polyurethane resin (comparative Example 2) had the same polishing property in the initial and end parts of the tape which was once wound around a hub, but caused many scratches on the surface of the disk.

From the results it is understood that the abrasive tapes according to the present invention have excellent polishing properties in their entire length, and can polish the surface of a material to be polished smoothly without scratching the surface.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is;

1. A method for producing an abrasive tape comprising the steps:

(1) dispersing and mixing by mechanical stirring abrasive grains having a grain size of 0.05 to 10 μm into at least one binder resin to from an abrasive paint having air bubbles therein; and (2) coating said abrasive paint on one surface of a flexible substrate to form an abrasive layer, said layer containing pores in content of 10 to 60% by volume based on a volume of said abrasive layer.

2. A method for producing an abrasive tape comprising the steps:

(1) dispersing abrasive grains having a grain size of 0.05 to 10 μm into at least two different binder resins, wherein said resins react with one another to generate air bubbles, to form an abrasive paint having air bubbles therein; and (2) coating said abrasive paint on one surface of a flexible substrate to form an abrasive layer, said layer containing pores in content of 10 to 60% by volume based on a volume of said abrasive layer.

3. The method of producing an abrasive tape according to claim 1, wherein said pore content ranges from 20 to 50% by volume of said abrasive layer.

4. The method of producing an abrasive tape according to claim 2, wherein said pore content ranges from 20 to 50% by volume of said abrasive layer.

5. The method for producing an abrasive tape according to claims 1 or 2, wherein content of said abrasive grain in said abrasive layer is from 20 to 95% by volume based on a total volume of all solid elements in said abrasive layer.

6. The method for producing an abrasive tape according to claim 5, wherein content of said abrasive grain in said abrasive layer is from 50 to 90% by volume.

* * * * *